US007230474B2

(12) United States Patent
Yamamoto et al.

(10) Patent No.: US 7,230,474 B2
(45) Date of Patent: Jun. 12, 2007

(54) CURRENT DRIVE CIRCUIT REDUCING VDS DEPENDENCY

(75) Inventors: Isao Yamamoto, Kyoto (JP); Koichi Miyanaga, Kyoto (JP)

(73) Assignee: Rohm Co., Ltd. (JP)

( * ) Notice: Subject to any disclaimer, the term of this patent is extended or adjusted under 35 U.S.C. 154(b) by 152 days.

(21) Appl. No.: 11/001,264

(22) Filed: Dec. 1, 2004

(65) Prior Publication Data

US 2005/0122139 A1 Jun. 9, 2005

(30) Foreign Application Priority Data

Dec. 8, 2003 (JP) ..... 2003-409662

(51) Int. Cl.
*G05F 1/10* (2006.01)

(52) U.S. Cl. ..... 327/543

(58) Field of Classification Search ..... 323/315, 323/316; 327/535, 537, 538, 539, 540, 541, 327/543

See application file for complete search history.

(56) References Cited

U.S. PATENT DOCUMENTS 5,252,910 A * 10/1993 Agaesse ..... 323/315
6,114,844 A * 9/2000 Chang et al. ..... 323/281
6,621,235 B2 * 9/2003 Chang ..... 315/216
6,628,252 B2 * 9/2003 Hoshino et al. ..... 345/82
6,633,198 B2 * 10/2003 Spalding, Jr. ..... 327/538
6,798,182 B2 * 9/2004 Charlon ..... 323/316
6,980,181 B2 * 12/2005 Sudo ..... 345/82
6,982,527 B2 * 1/2006 Lee et al. ..... 315/224
6,998,831 B2 * 2/2006 Charlon ..... 323/316
7,057,442 B2 * 6/2006 Hwang et al. ..... 327/538

FOREIGN PATENT DOCUMENTS

JP 2001-175343 6/2001

* cited by examiner

*Primary Examiner*—Jeffrey Zweizig
(74) *Attorney, Agent, or Firm*—Cantor Colburn LLP

(57) ABSTRACT

A first transistor is provided in a first route and a second transistor is provided in a second route, the first route and the second route constituting a current mirror circuit. The sources of the transistors are grounded. In order to match $V_{DS}$ of the first transistor and that of the second transistor match each other, there are provided an operational amplifier receiving the drain voltages of the transistors, and a third transistor having a gate thereof connected to the output of the operational amplifier. The third transistor is provided in the first route. As a result, the current fed to the third transistor is controlled so that $V_{DS}$ of the first transistor and that of the second transistor match each other.

8 Claims, 5 Drawing Sheets

CURRENT DRIVE CIRCUIT REDUCING VDS DEPENDENCY

BACKGROUND OF THE INVENTION

The present invention generally relates to current drive circuits and, more particularly, to a current drive circuit of a current mirror type. A current mirror circuit is often used to feed a desired current to a load. A current mirror circuit generally used has the following structure. The gates of first and second transistors are connected to each other and so are the sources of the transistors. The sources of the transistors are grounded and the gates are connected to the drain of the first transistor. A target load is connected to the drain of the second transistor.

A reference current is fed to the drain of the first transistor and a drive current proportional to the reference current is fed to the load connected to the drain of the second transistor. The ratio between the reference current and the drive current, i.e. the mirror ratio, is determined by the ratio between source-drain currents of the first and second transistors. The source-drain current $I_{DS}$ is proportional to the channel width W of a transistor and inversely proportional to the channel length L thereof. Generally, the source-drain current is determined by the ratio W/L.

The ratio between the reference current and the drive current is determined by the ratio W/L of the first and second transistors. However, such a definition is based on an assumption that source-drain voltages $V_{DS}$ of the transistors are identical. Strictly speaking, it is known that the source-drain current $I_{DS}$ of a transistor is proportional to $(V_{GS}-V_{th})^2*(W/L)*(1+\lambda V_{DS})$, meaning that $I_{DS}$ is slightly affected by $V_{DS}$. $\lambda$ indicates a channel length modulation coefficient, $V_{GS}$ indicates a gate-source voltage and $V_{th}$ indicates a threshold voltage. Accordingly, even when W/L is designed properly, an accurate drive current is not obtained when $V_{DS}$ of one of the transistors is different from an ideal value.

BRIEF SUMMARY OF THE INVENTION

The present invention has been done in light of the aforementioned problem and its objective is to provide a current drive circuit less dependent on $V_{DS}$ than the related art.

The present invention provides a current drive circuit of a current mirror type in which gates and sources of a first transistor and a second transistor are connected to each other, the sources of the transistors are grounded, the gates of the transistors are connected to the drain of the first transistor, a reference current is fed to the drain of the first transistor, a target load is connected to the drain of the second transistor, and a drive current proportional to the reference current is fed to the load, comprising: an adjustment circuit which makes a drain potential of the first transistor and a drain potential of the second transistor to approach each other while maintaining a direct connection between the drain of the second transistor and the load.

According to this structure, $V_{DS}$ of the first transistor and that of the second transistor approach each other so that an accurate drive current is obtained. Since the drain of the second transistor and the load are maintained in direct connection with each other, the drive current can be fed generally more accurately and efficiently than when an extra transistor or the like is introduced between the second transistor and the load.

The adjustment circuit may comprise: an operational amplifier having two inputs thereof connected to the drain of the first transistor and the drain of the second transistor, respectively; and a third transistor provided in series between the drain of the first transistor and the gates of the first and second transistors, and wherein an output of the operational amplifier is connected to a gate of the third transistor.

In an alternative mode, the adjustment circuit may comprise: a third transistor connected in series between the drain of the first transistor and the gates of the first and second transistors; and a fourth transistor having a source thereof connected to a gate of the third transistor and a drain thereof grounded, and being fed a constant current, and wherein a gate of the fourth transistor is connected to the drain of the second transistor.

The current drive circuit may further comprise a circuit which invalidates the operation of the adjustment circuit. The circuit (hereinafter, referred to as an invalidating circuit) may operate when $V_{DS}$ of the first transistor and that of the second transistor are close to each other. This is because the adjustment circuit is unnecessary when $V_{DS}$ of the first transistor is close to that of the second transistor. One of the advantages obtained by invalidating the adjustment circuit is reduction in power consumption.

The invalidating circuit may function when the gate-source voltage $V_{GS}$ is high. Since the source-drain current $I_{DS}$ is proportional to $(V_{GS}-V_{th})^2*(W/L)*(1+\lambda V_{DS})$, the term $(V_{GS}-V_{th})^2$ predominantly affects $I_{DS}$ when $V_{GS}$ is high. Since $V_{DS}$ affects $I_{DS}$ only slightly in this state, the aforementioned approach is useful.

The present invention also provides a current drive circuit comprising: a first route feeding a reference current; a second route including a target load and feeding a drive current to the load; a first resistor provided in series in the first route; a second resistor provided in series in the second route; an operational amplifier having two inputs thereof connected to an end of the first resistor (hereinafter, referred to as the top end of the first resistor) and an end of the second resistor (hereinafter, referred to as the top end of the second resistor), respectively, wherein a transistor is provided in the second route and a gate of the transistor is connected to an output of the operational amplifier. The first route and the second route constitute a current mirror circuit. Since the operational amplifier operates to match the potential at the top end of the first resistor and that of the second resistor, an accurate mirror ratio is produced. By utilizing the resistors and the operational amplifier, the problem of $V_{DS}$ dependency is eliminated.

The current drive circuits according to the invention may be built in an integrated circuit device (hereinafter, simply referred to as an LSI), and a route for feeding the drive current to the load external to the LSI via a terminal of the integrated circuit device may be formed. Since a power supply voltage applied to the load is unknown, reduction in the level of $V_{DS}$ dependency according to the invention is effective in maintaining an accurate drive current.

BRIEF DESCRIPTION OF THE SEVERAL VIEW OF THE DRAWING

DETAILED DESCRIPTION OF THE INVENTION

First Embodiment

Figure 1:
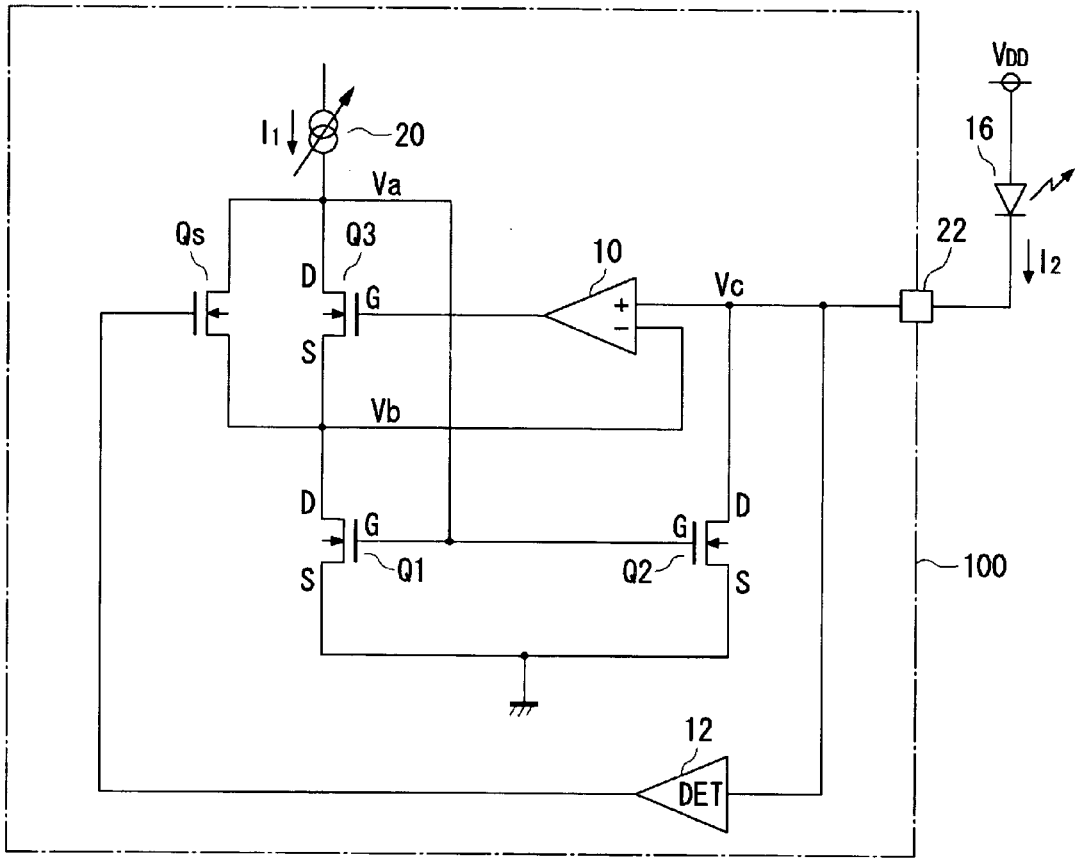
FIG. 1 shows a structure of a current drive circuit according to a first embodiment of the present invention.

FIG. 1 shows a structure of a current drive circuit 100 according to the first embodiment. The current drive circuit 100 is built in an LSI. The gates (indicated as G in the figure) of a first transistor Q1 and a second transistor Q2, which are n-channel FETs, are connected to each other, and the sources (indicated as S in the figure) of the transistors are grounded. The gates are connected to a constant-current circuit 20 in series with the drain of the first transistor Q1 via a third transistor Q3, an n-channel FET. The constant current circuit 20 is configured to control a current value outside the LSI, using a known technology.

The drain of the third transistor Q3 is connected to the output of the constant current circuit 20 and the gates of the transistors. The source of the third transistor Q3 is connected to the drain of the first transistor Q1 and the inverting input of an operational amplifier 10. The gate of the third transistor Q3 is connected to the output of the operational amplifier 10. The non-inverting input of the operational amplifier 10 is connected to the drain of the second transistor Q2, the input of a detector 12 and a terminal 22. The operational amplifier 10 and the third amplifier Q3 operate as an adjustment circuit. The output of the detector 12 is connected to the gate of a transistor Qs, an n-channel FET. The detector 12 and the transistor Qs constitute a shut circuit for the adjustment circuit, the shunt circuit operating as an invalidating circuit. When the input voltage is higher than a predetermined voltage, the detector 12 brings the output thereof low, turns the transistor Qs for invalidation on and causes the current of the constant-current circuit 20 to bypass. This invalidates the third transistor Q3, thus causing the current drive circuit 100 to be returned to a conventional current mirror circuit.

A light-emitting diode 16 is provided as a load outside the LSI and a power supply voltage $V_{DD}$ is applied to the anode of the diode. The cathode of the light-emitting diode 16 is connected to a terminal 22 of the LSI.

It will be assumed that the output voltage of the constant current circuit 20 is indicated by Va, the drain voltage of the first transistor Q1 by Vb, and the drain voltage of the second transistor Q2 by Vc. Va is a sufficiently high voltage. When a reference current $I_1$ is fed to the constant-current circuit 20, the on-state of the third transistor Q3 is controlled as a result of an imaginary short circuit being established in the operational amplifier 10. Consequently, Vb and Vc are substantially equal. With this, $V_{DS}$ of the first transistor Q1 and that of the second transistor Q2 are substantially equal to each other, $V_{DS}$ dependency of the mirror ratio is eliminated. The drive current $I_2$ of a target value is fed to the light-emitting diode 16 and a desired light emission state is produced.

When $V_{DD}$ is sufficiently high, the effect from $V_{DS}$ is negligible as mentioned before. In this case, the detector 12 is operated so as to turn Qs on. The current drive circuit 100 as a whole is then returned to a conventional current mirror circuit. As a result, power loss in the third transistor Q3 is reduced to zero.

Thus, $V_{DS}$ matching using the adjustment circuit according to the first embodiment is useful since $V_{DD}$ is different from application to application and unknown when the LSI is designed.

Second Embodiment

Figure 2:
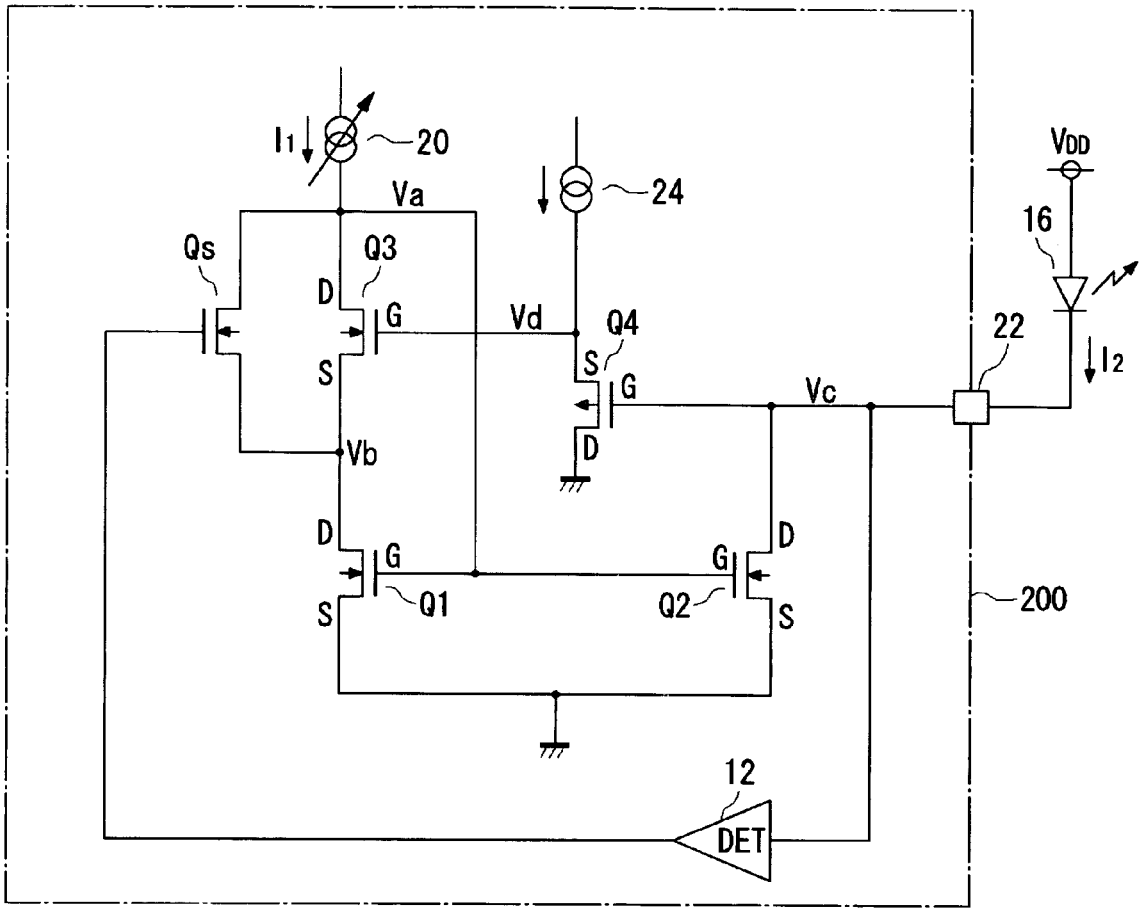
FIG. 2 shows a structure of a current drive circuit according to a second embodiment of the present invention.

FIG. 2 shows a structure of a current drive circuit 200 according to the second embodiment. In FIG. 2, those components that are identical to the corresponding components of FIG. 1 are denoted by the same symbols and the description thereof is omitted.

The following description concerns only a difference from the structure of FIG. 1. In the structure of FIG. 2, there is provided a fourth transistor Q4, a p-channel FET, in place of the operational amplifier 10. The source of the fourth transistor Q4 is connected to the output of a constant-current circuit 24 and the gate of the third transistor Q3. The gate of Q4 is connected to the terminal 22 and the input of the detector 12. The drain of Q4 is grounded. The voltage at the output of the constant-current circuit 24 is indicated as Vd.

It is assumed that Va and Vd are sufficiently high. Given that the threshold voltage of the third transistor Q3 and that of the fourth transistor Q4 are designated as $V_{th}$3 and $V_{th}$4, respectively, the system becomes stable in a state in which $$Vb=Vd-V_{th}3$$

$$Vc=Vd-V_{th}4$$

Since it is possible to ensure that $V_{th}$3 and $V_{th}$4 are substantially equal, it naturally results that Vb=Vc so that the same advantage as available in the first embodiment is also available according to the second embodiment.

Third Embodiment

Figure 3:
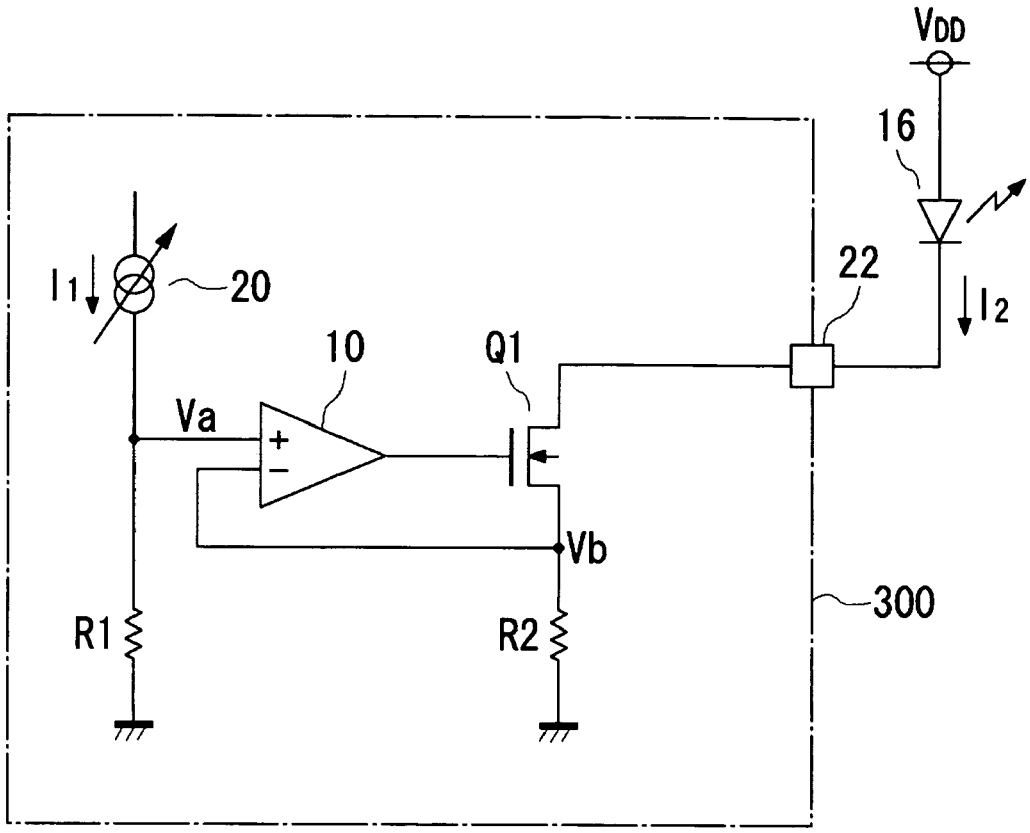
FIG. 3 shows a structure of a current drive circuit according to a third embodiment of the present invention.

FIG. 3 shows a structure of a current drive circuit 300 according to the third embodiment. The current drive circuit 300 is provided with the constant-current circuit 20 which feeds the reference current $I_1$ to a first resistor R1. The constant-current circuit 20 and the first resistor R1 constitute a first route. The drive current $I_2$ flows in the light-emitting diode 16, a target load. $I_2$ is introduced into the LSI via the terminal 22 and reaches the ground via the first transistor Q1 and a second resistor R2. A route including the light-emitting diode 16 at one end and the ground at the other constitutes a second route. The two inputs of the operational amplifier 10 are connected to the top end of the first resistor R1 and the top end of the second resistor R2, respectively. The output of the operational amplifier 10 is connected to the gate of the first transistor Q1.

Indicating the voltage at the top end of the first resistor R1 as Va and the voltage at the top end of the second resistor R2 as Vb, the degree of on-state of the first transistor Q1 is controlled such that Va=Vb according to the operation of the operational amplifier 10. Accordingly, the drive current $I_2$ is given by $$I_2=I_1*R1/R2 \quad (1)$$

By building the resistors with a high precision, high-precision control is enabled. Voltage adjustment using the operational amplifier 10 according to the third embodiment is useful since the power supply voltage of the load outside the LSI is unknown. A consideration of the precision of the resistor values will be given in the next embodiment.

Fourth Embodiment

Figure 4:
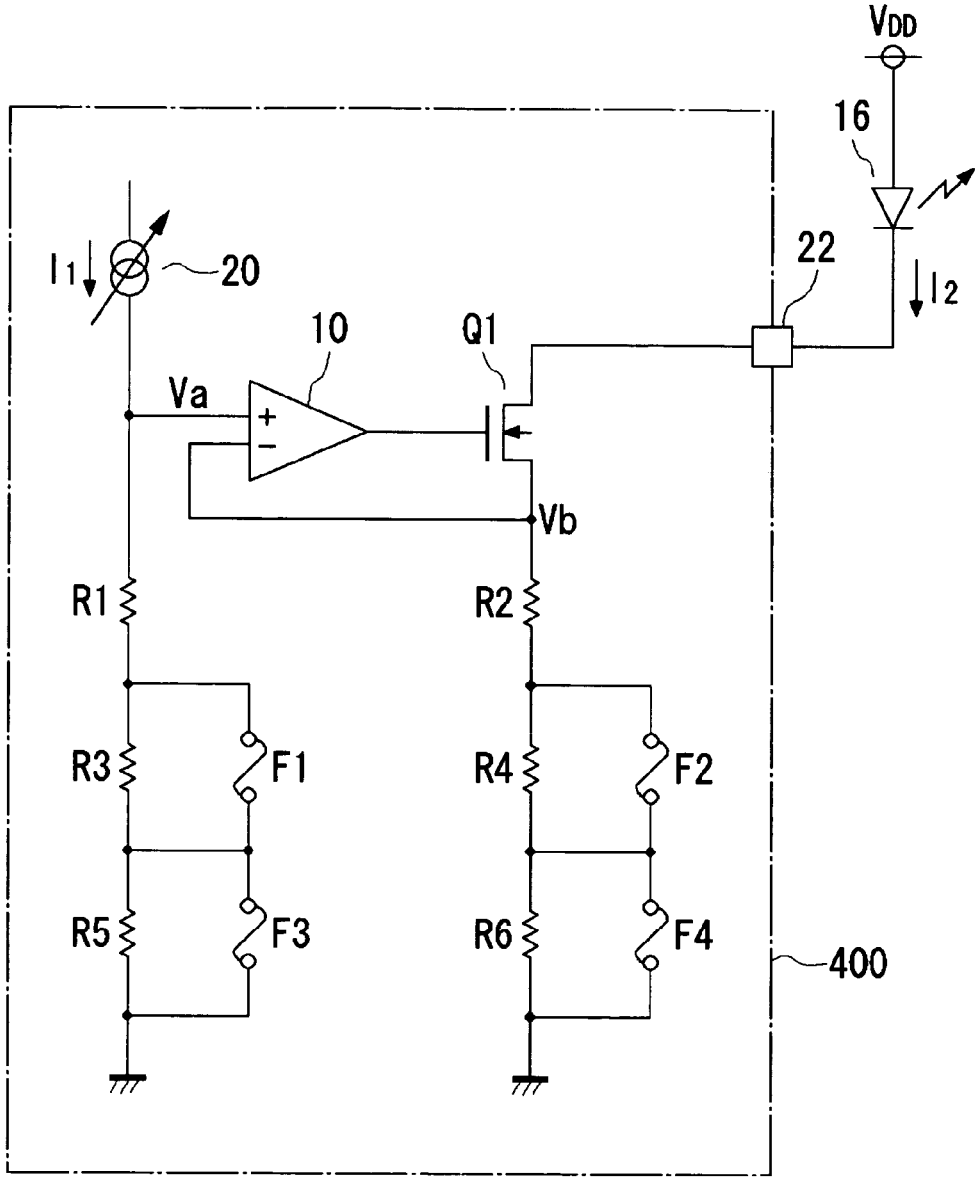
FIG. 4 shows a structure of a current drive circuit according to a fourth embodiment of the present invention.

FIG. 4 shows a structure of a current drive circuit 400 according to the fourth embodiment. A difference from the structure of FIG. 3 is that a third resistor R3 and a fifth resistor R5 are additionally provided in series with the first resistor R1 in the first route. A first fuse F1 and a third fuse F3 are coupled to be parallel with the respective resistors. A fourth resistor R4 and a sixth resistor R6 are provided in series with the second resistor R2 in the second route. A second fuse F2 and a fourth fuse F4 are coupled to be parallel with the respective resistors. The values of the first resistor R1 and the second resistor R2 are designed to satisfy the equation (1) shown in the third embodiment. The values of the other resistors are made to be sufficiently lower than the values of the first resistor R1 and the second resistor R2 to enable trimming for fine-tuning of resistance value.

In this structure, when the drive current $I_2$ is greater than desired, the second fuse F2 or the fourth fuse F4, or both, are blown by laser trimming. When the drive current $I_2$ is smaller than desired, the first fuse F1 or the third fuse F3, or both, are blown. In this way, the drive current $I_2$ is generated with a high precision.

Figure 5:
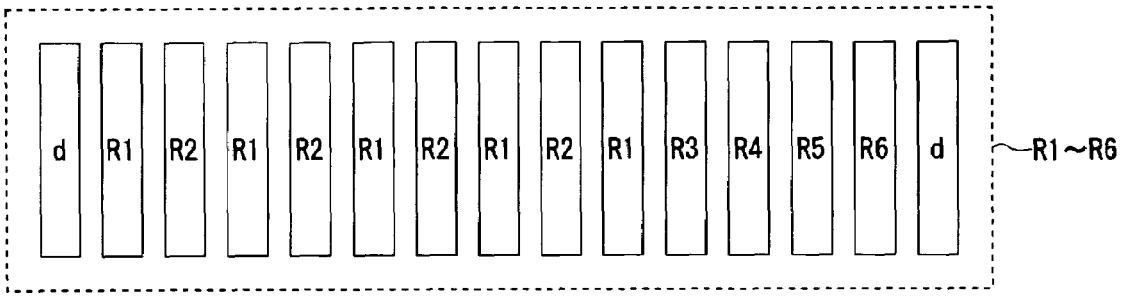
FIG. 5 is a schematic view showing an arrangement of resistors in the current drive circuit of FIG. 4.

Not only the provision of an arrangement in which resistors are adjustable but also the improvement of the level of resistance value pairing of the first resistor R1 and the second resistor R2 are important. FIG. 5 is a schematic view showing an arrangement of resistors built into the LSI in consideration of the above point. Referring to FIG. 5, "d" indicates a dummy area. In this view of a given layer, symbols "R1" and the like indicate wirings for resistors R1 and the like. The fist resistor R1 is indicated as five discrete areas in this illustration. The areas are actually connected to each other in another layer not shown, forming a single wiring in a zig-zag manner. In LSI fabrication, a desired resistance value is created by selecting appropriate impurities and controlling the quantity of the impurities and the penetration depth. In the case of ion implantation, the quantity of the impurities is controlled by the doped amount, the penetration depth is controlled by an acceleration voltage and the thickness of a sacrificial film provided on a substrate when ion implantation is conducted.

The second resistor R2 is indicated as four discrete areas constituting a single wiring in a zig-zag manner. By providing the first resistor R1 and the second resistor R2 as zig-zag wirings, the characteristics thereof are matched with each other. Therefore, displacement of the resistance value of the first resistor R1 and that of the second resistor R2 occur, if ever, in the same direction so that a satisfactory level of resistor pairing is ensured. Thus, the drive current $I_2$ close to the target value is produced. For similar reasons, the third resistor R3 and the fourth resistor R4 are provided in proximity to each other, and the fifth resistor R5 and the sixth resistor R6 are provided in proximity to each other.

Described above is an explanation based on the embodiments. The embodiment of the present invention is only illustrative in nature and it will be obvious to those skilled in the art that various variations in constituting elements are possible within the scope of the present invention. For example, the MOSFET transistors in the embodiments may be bipolar transistors.

According to the current drive circuit of the present invention, a drive current accurately proportional to a reference current is generated.

What is claimed is:

1. A current drive circuit of a current mirror type in which gates and sources of a first transistor and a second transistor are connected to each other, the sources of the transistors are grounded, the gates of the transistors are connected to the drain of the first transistor, a reference current is fed to the drain of the first transistor, a target load is connected to the drain of the second transistor, and a drive current proportional to the reference current is fed to the load, comprising:

an adjustment circuit which makes a drain potential of the first transistor and a drain potential of the second transistor to approach each other while maintaining a direct connection between the drain of the second transistor and the load;

a third transistor connected in series between the drain of the first transistor and the gates of the first and second transistors; and a fourth transistor having a source thereof connected to a gate of the third transistor and a drain thereof grounded, and being fed a constant current, and wherein a gate of the fourth transistor is connected to the drain of the second transistor.

2. A current drive circuit of a current mirror type in which gates and sources of a first transistor and a second transistor are connected to each other, the sources of the transistors are grounded, the gates of the transistors are connected to the drain of the first transistor, a reference current is fed to the drain of the first transistor, a target load is connected to the drain of the second transistor, and a drive current proportional to the reference current is fed to the load, comprising:

an adjustment circuit which makes a drain potential of the first transistor and a drain potential of the second transistor to approach each other while maintaining a direct connection between the drain of the second transistor and the load; and a circuit which invalidates the operation of said adjustment circuit.

3. A current drive circuit of a current mirror type in which gates and sources of a first transistor and a second transistor are connected to each other, the sources of the transistors are grounded, the gates of the transistors are connected to the drain of the first transistor, a reference current is fed to the drain of the first transistor, a target load is connected to the drain of the second transistor, and a drive current proportional to the reference current is fed to the load, comprising:

an adjustment circuit which makes a drain potential of the first transistor and a drain potential of the second transistor to approach each other while maintaining a direct connection between the drain of the second transistor and the load;

an operational amplifier having two inputs thereof connected to the drain of the first transistor and the drain of the second transistor, respectively; and a third transistor provided in series between the drain of the first transistor and the gates of the first and second transistors, and wherein an output of the operational amplifier is connected to a gate of the third transistor; and a circuit which invalidates the operation of said adjustment circuit.

4. The current drive circuit according to claim 1, further comprising a circuit which invalidates the operation of said adjustment circuit.

5. The current drive circuit according to claim 1, wherein said current drive circuit is built in an integrated circuit device and a route for feeding the drive current to the load external to via a terminal of the integrated circuit device is formed.

6. The current drive circuit according to claim 2, wherein said current drive circuit is built in an integrated circuit device and a route for feeding the drive current to the load external to via a terminal of the integrated circuit device is formed.

7. The current drive circuit according to claim 3, wherein said current drive circuit is built in an integrated circuit device and a route for feeding the drive current to the load external to via a terminal of the integrated circuit device is formed.

8. The current drive circuit according to claim 4, wherein said current drive circuit is built in an integrated circuit device and a route for feeding the drive current to the load external to via a terminal of the integrated circuit device is formed.

* * * * *